US007011008B2

(12) United States Patent
McLean et al.

(10) Patent No.: US 7,011,008 B2
(45) Date of Patent: Mar. 14, 2006

(54) POWER GEAR GUILLOTINE TRIMMER

(75) Inventors: Mark A. McLean, Wausau, WI (US); William J. Schulz, Mosinee, WI (US); Jason Wolf, Schofield, WI (US)

(73) Assignee: Alterra Holdings Corporation, Tigard, OR (US)

( * ) Notice: Subject to any disclaimer, the term of this patent is extended or adjusted under 35 U.S.C. 154(b) by 24 days.

(21) Appl. No.: 10/291,280

(22) Filed: Nov. 8, 2002

(65) Prior Publication Data

US 2004/0089126 A1 May 13, 2004

(51) Int. Cl.
*B26D 5/08* (2006.01)

(52) U.S. Cl. ..... 83/605; 83/455; 83/600; 83/601; 83/616; 83/698.11; D18/34.7

(58) Field of Classification Search ..... 83/605, 83/597, 600, 601, 616, 582, 607, 698.1, 698.11, 83/455, 468.4, 624; D18/34, 99, 34.1–34.9
See application file for complete search history.

(56) References Cited

U.S. PATENT DOCUMENTS

| | | | | | |
|---|---|---|---|---|---|
| 804,579 | A | * | 11/1905 | Burgess | 83/601 |
| 2,254,374 | A | * | 9/1941 | Laukhuff | 83/387 |
| 2,256,606 | A | * | 9/1941 | Blanc | 83/468 |
| 2,270,473 | A | * | 1/1942 | Porcelli | 83/387 |
| 2,591,472 | A | * | 4/1952 | Segal | 83/389 |
| 3,077,805 | A | | 2/1963 | Stanley | |
| 4,010,063 | A | * | 3/1977 | Natter | 156/510 |
| 4,957,025 | A | * | 9/1990 | Beno | 83/607 |
| 5,249,495 | A | * | 10/1993 | Renk | 83/468.3 |
| 5,370,027 | A | * | 12/1994 | Mathian | 83/527 |
| 6,079,304 | A | * | 6/2000 | Bisceglia | 83/51 |
| D435,585 | S | * | 12/2000 | Chiang et al. | D18/34 |
| 2003/0010176 | A1 | * | 1/2003 | Chiang | 83/618 |

FOREIGN PATENT DOCUMENTS

| | | | |
|---|---|---|---|
| DE | 12301 | C | 5/1880 |
| DE | 127426 | C | 10/1900 |
| EP | 0353398 | A | 2/1990 |
| GB | 1068915 | A | 5/1967 |

* cited by examiner

*Primary Examiner*—Allan N. Shoap
*Assistant Examiner*—Phong Nguyen
(74) *Attorney, Agent, or Firm*—Foley & Lardner LLP

(57) ABSTRACT

A device for cutting pieces of material comprising a base, a bridge assembly and a lever arm. The bridge assembly includes a gear assembly operatively connected to the base. The lever arm is coupled to the gear assembly, and a linking member is coupled to the gear assembly; A material clamp is operatively connected to the linking member, and a cutting blade is operatively connected to the linking member. The movement of the lever arm of the first position towards the second position results in the gear assembly and the linking member cooperating to cause the material clamp to move towards the base and affix the position of pieces of material located between the base and the material clamp. The cutting blade comes into contact with and severs the pieces of material after the position of the pieces of material has been fixed by the material clamp.

23 Claims, 4 Drawing Sheets

POWER GEAR GUILLOTINE TRIMMER

FIELD OF THE INVENTION

The present invention is related generally to devices for cutting materials. More particularly, the present invention is related to material cutters or trimmers that are capable of cutting a relatively large number of pages of material with a single cut.

BACKGROUND OF THE INVENTION

A number of different types of paper trimmers are conventionally known. One type of paper trimmer typically includes a cutting blade with a free end and fixed end, wherein the free end rotates towards or away from the material to be cut. Conventional trimmers of this sort are relatively simple in design and are reasonably effective at cutting one sheet or a few sheets of material at a time.

Conventional trimmers of this sort, however, include a number of shortcomings. For example, users often desire to cut several sheets of material at a time. With conventional trimmers however, the individual sheets of material have a tendency to shift relative to each other while the cut is being made. As a result, users often have a difficult time creating straight and clearly defined cuts on multiple sheets of material. Alternatively, a number of conventional trimmers include a clamping mechanism for fixing the position of the materials to be cut. Such clamping mechanisms are structurally separate and disconnected from the actual cutting blade, however, and the user is required to first clamp the materials in place, then perform the cutting action and still later unclamp the materials. In addition to being a relatively cumbersome and multistep process, the manual clamping can still result in a relatively imprecise cut due to the shifting of the material during the cutting operation.

Additionally, many conventional trimmers include a cutting blade on one side of a lever arm which is lowered directly onto the material to be cut. Because the lever arm rotates about the fixed end of the lever arm, however, the portion of the material closest to the fixed end of the lever arm is cut before the material farthest away from the fixed end. This also adds to the likelihood of an imprecise cut as material is capable of shifting while the cut is taking place. Furthermore, the cutting blade on the lever remains completely exposed when in the retracted position, creating a serious safety issue.

For all of these reasons, it would be desirable to develop an improved material cutting device which both automatically constrains the material to be cut in a certain position, while also providing for improved safety as well as straight and more precise cuts relative to conventional material trimmers.

SUMMARY OF THE INVENTION

It is therefore an object of the invention to provide an improved material trimmer that is capable of cutting a relatively large number of pages of material with a single cut.

It is another object of the invention to provide an improved material trimmer that automatically fixes the position of the material to be cut before the cutting action takes place.

It is a further object of the invention to provide an improved material trimmer wherein each part of the material is cut simultaneously by the associated cutting blade.

It is yet another object of the invention to provide an improved material trimmer wherein the blade remains substantially unexposed to prevent injury to the user.

It is still another object of the present invention to provide an improved material trimmer that is simple to manufacture.

In accordance with the above objects, a "guillotine" material trimmer according to the present invention comprises a base, a bridge assembly and a lever arm. A pair of gear members are operatively connected to the lever arm, and a linking member is operatively connected to one of the gearing members. When the lever arm is actuated, the cooperation of the gearing members and the linking member causes an associated clamp to fix the position of the material to be cut. Once the position is secured, a cutting blade operatively connected to the linking member uniformly cuts through the material.

These and other objects, advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF THE INVENTION

Figure 1:
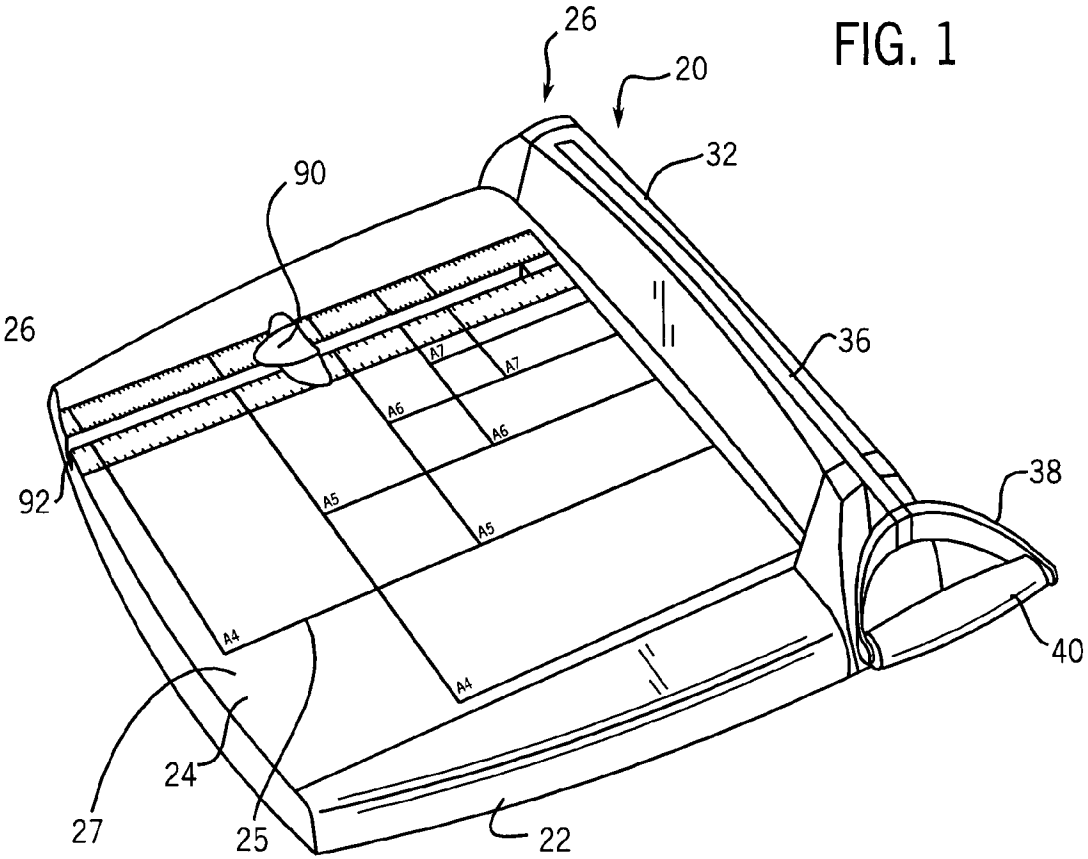
FIG. 1 is a perspective view of a material cutter constructed according to the present invention.
Figure 2:
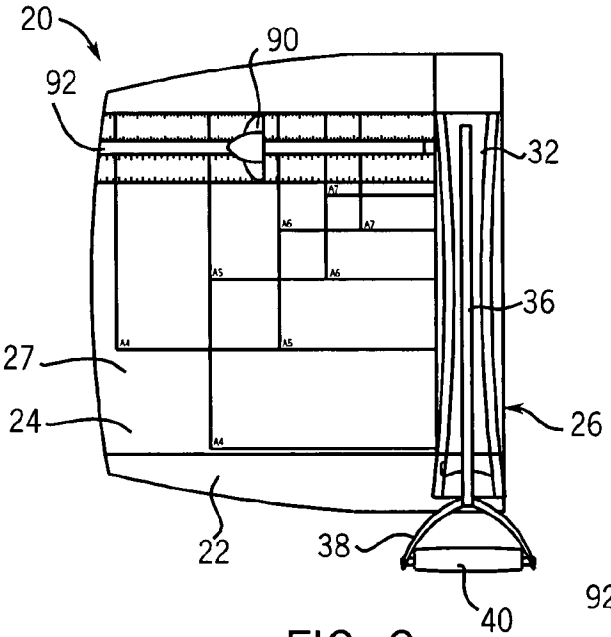
FIG. 2 is a top view of the material cutter of FIG. 1.

A material trimmer constructed according to the present invention is shown generally at 20 in FIGS. 1–2. The material trimmer 20 includes a base 22 with a cutting mat 24. A bridge assembly, shown generally at 26, is coupled to the base 22. A lever arm 36 is operatively connected to and rests partially within the bridge 26. A latch 42 is provided for securing the lever arm 36 to the bridge cover 32 when the material trimmer is not in use.

In one embodiment and as shown in FIGS. 1 and 2, the cutting mat 24 can also include a plurality of indicia 25. The plurality of indicia 25 can represent a variety of features including English and metric measurements, in addition to lines for aligning papers of different sizes (i.e. A4, legal, etc.). In one embodiment of the invention, the plurality of indicia 25 are included on a removable plate 27 such that different types of indicia can be used on the same material trimmer 20. The cutting mat 24 may also include a removable, replaceable and deformable cutting strip 64 (see FIG. 3).

In a preferred embodiment of the invention, the lever arm 36 includes a handle 38. The handle 38 has a gripping portion 40 that is oriented about a major axis that is substantially orthogonal to the major axis of the lever arm 36. This positioning of the gripping portion 40 of the handle 38 provides the user with increased leverage on the lever arm 36 relative to conventional material trimmers, where the gripping portion of the handle 38 is substantially aligned with the major axis of the lever arm 36.

Figure 3:
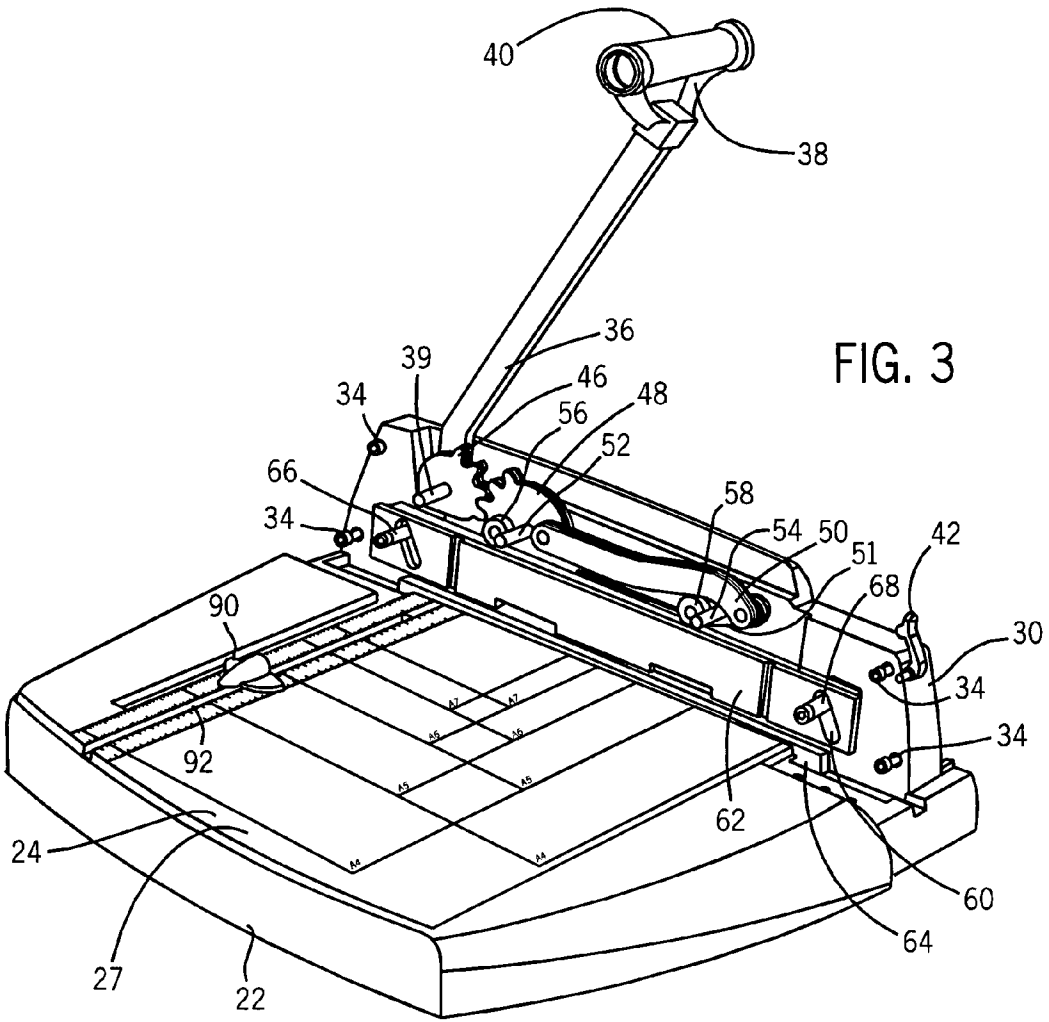
FIG. 3 is a perspective view of the material cutter of FIG. 1 with the bridge cover and front bridge portion removed and the lever arm in a first, open position.
Figure 4:
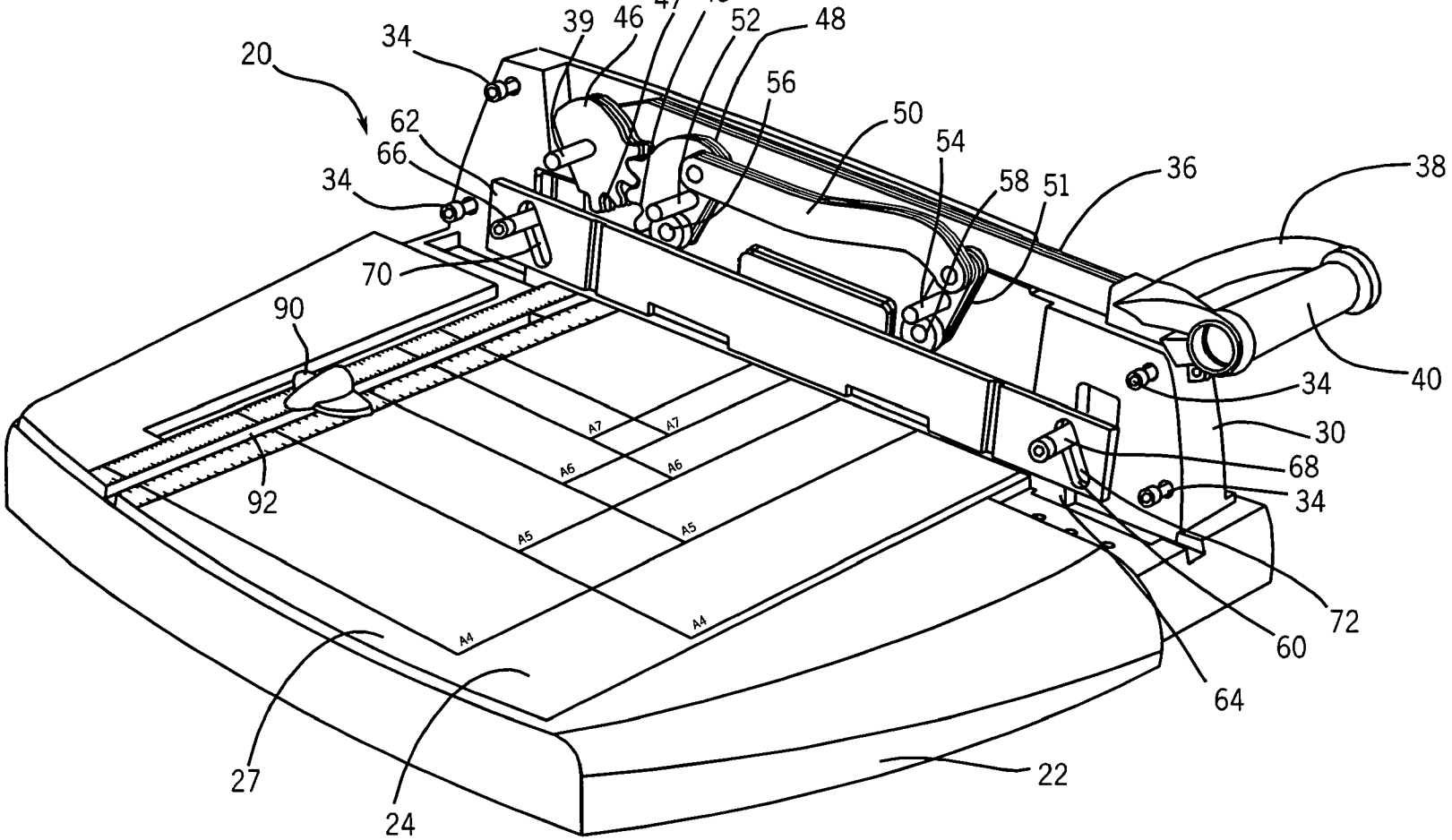
FIG. 4 is a perspective view of the material cutter of FIG. 3 with the lever arm in a second, closed position.
Figure 5:
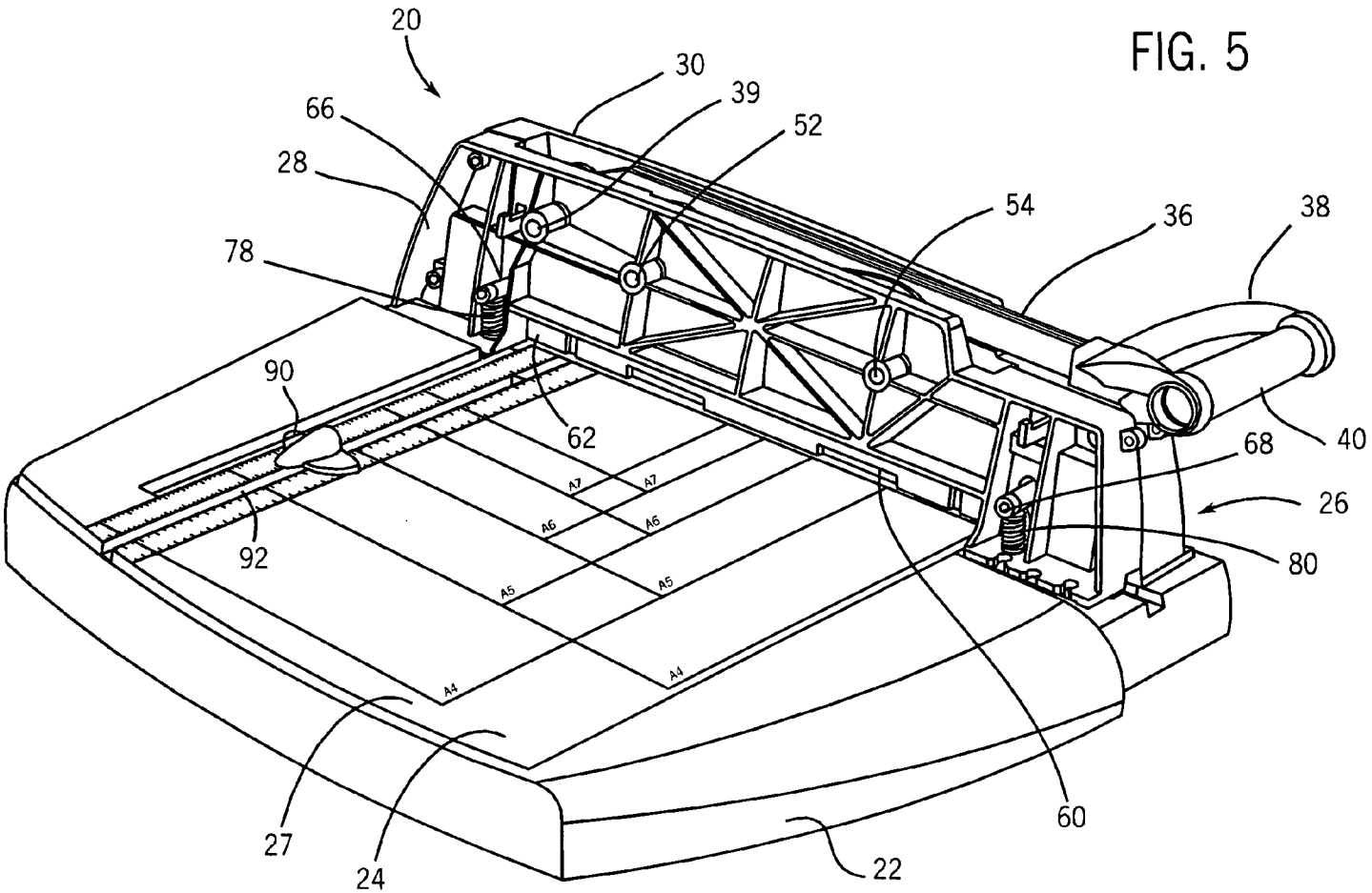
FIG. 5 is a perspective view of a portion of the material cutter of FIG. 1 with the bridge cover removed and the lever arm in the second, closed position.

The bridge assembly 26 comprises a bridge cover 32, as shown in FIGS. 1 and 2, and a front bridge portion 28 and a rear bridge portion 30, as shown in FIGS. 3–5. The front bridge portion 28 and the rear bridge portion 30 are coupled to each other by a plurality of fasteners 34 which can take a variety of forms such as screws, rivets, and other conventional such devices. The lever arm 36 is coupled to the front bridge portion 28 and the rear bridge portion 30 by a first pivot pin 39, about which the lever arm 36 is capable of pivoting.

As is shown in FIGS. 3–4 the lever arm 36 is also coupled to a gear assembly, shown generally at 44. In a preferred embodiment of the invention, the gear assembly 44 comprises a first gear 46 and a second gear 48. The first gear 46 includes a first toothed portion 47, and the second gear 48 includes a second toothed portion 49. The first toothed portion 47 and the second toothed portion 49 mateably engage each other. The second gear member 48 is coupled to a drive link 50. The drive link 50, in one embodiment of the invention, is coupled to a secondary link 51.

As shown in FIGS. 3–5, a cutting blade 60 and a clamp 62 are both located between the front bridge 28 and the rear bridge 30. The cutting blade 60 includes a first bushing 66 and a second bushing 68 coupled thereto. The first bushing 66 and the second bushing 68 mateably engage and pass through a first slot 70 and a second slot 72, respectively, within the clamp 62. Additionally the front bridge 28 may include a plurality of corresponding gaps (not shown) to receive the first bushing 66 and the second busing 68 in order to prevent any interference between the individual components. A first biasing member 78 is positioned below and biases the first bushing 66. Similarly, a second biasing member 80 is positioned below and biases the second bushing 68. In a preferred embodiment of the invention, the first biasing member 78 and the second biasing member 80 comprise coil springs, although other types of conventional springs or biasing members may also be used. The cutting blade 60 contacts a first roller 56 and a second roller 58 that are spaced apart from each other relative to the cutting blade 60. The first roller 56 rotates about a second pin 52 that is coupled to the second gear 48. Similarly, the second roller 58 rotates about a third pivot pin 54 which is coupled to the secondary link 51.

In one embodiment of the invention and as shown in FIGS. 1 and 2, the material trimmer 20 also includes a paper guide 90 which slides along the channel 92 in the base 22. The paper guide 90 may be used to help align the material that is to be cut, in addition to making particular measurements.

The operation of the material trimmer 20 is generally as follows. When the lever arm 36 is in a first, open position, as shown in FIG. 3, both the cutting blade 60 and the clamp 62 are physically separated from the cutting strip 64. At this time, a user is able to place paper or other material underneath both the clamp 62 and the cutting blade 60.

Once the paper or other material has been properly positioned, the user rotates the lever arm 36 towards the cutting mat 64. During this rotation, the first gear 46 and the second gear 48 and the respective first and second toothed portions 47 and 49 mateably engage and cooperate with each other, resulting in a counterclockwise rotation of the first gear 46 and a clockwise rotation of the second gear 48. The clockwise rotation of the second gear 48 results in a similar movement of the drive link 50, which also causes the secondary link 51 to move. The movement of the second gear 48 moves the drive link 50 about the second pivot pin 52 and the secondary link 51 moves about the third pivot pin 54, applying a force against both the first roller 56 and the second roller 58. In particular, this action causes the drive link 50 and the secondary link 51 to apply a downward force to the cutting blade 60. Because the first roller 56 and the second roller 58 are separated from each other along the cutting blade 60, the downward force applied to the cutting blade 60 is more uniform across the entire length of the cutting blade 60 than the force applied by conventional paper trimmers, resulting in the cutting blade 60 during use approaching the cutting mat 24 substantially uniformly along the entire blade 60.

As the cutting blade 60 is forced downwards towards the cutting strip 64, the first bushing 66 and the second bushing 68 provide a downward force against the clamp 62, while the first biasing member 78 and the second biasing member 80 act in the opposite direction against the first bushing 66 and the second bushing 68. The downward force against the clamp 62 causes the clamp 62 to also move towards the cutting strip 64. Because the lower portion of the clamp 62 is closer to the cutting strip 64 than the lower portion of the cutting blade 60 in the first position, the downward force on both the clamp 62 and the cutting blade 60 results in the clamp 62 coming into contact with the material to be cut before the cutting blade 60 comes into contact with the same material. The clamp 62 therefore effectively and automatically affixes or constrains the position of the material before the cutting action begins.

Once the clamp 62 fixes the position of the material to be cut, the clamp 62 is incapable of additional downward movement. The cutting blade 60, however, is capable of continued downward movement as the first bushing 66 and the second bushing 68 slide along the first slot 70 and the second slot 72, respectively, against the first biasing member 78 and the second biasing member 80. This arrangement permits the cutting blade 60 to continue moving downward, coming into contact and cutting the material whose position has been affixed by the clamp 62.

As shown in FIGS. 4 and 5, when the lever arm 36 is in a second, closed position, the first roller 56 and the second roller 58 have forced both the clamp 62 and the cutting blade 60 to come into contact with the cutting strip 64. Additionally, the first bushing 66 and the second bushing 68 have both moved downward relative to the clamp 62.

When the user lifts the lever arm 36 back towards the first, open position, the above actions will take place in reverse, with the cutting blade 60 first being raised as the first bushing 66 and the second bushing 68 move upward in the first slot 70 and the second slot 72, respectively, in part due to the biasing action of the first biasing member 78 and the second biasing member 80. This will be followed by both the cutting blade 60 and the clamp 62 moving upward, away from the cutting mat 24 as the lever arm 36 continues to move upward.

It should be understood that the above description of the invention and specific examples and embodiments, while indicating the preferred embodiments of the present invention, are given by demonstration and not limitation. For example, more than two rollers could be used for contacting the clamp 62, and these rollers could be located in a variety of positions. Many changes and modifications within the scope of the present invention may therefore be made without departing from the spirit thereof and the present invention includes all such changes and modifications.

What is claimed is:

1. A device for cutting pieces of material, comprising:

a base;

a gear assembly operatively connected to the base;

a lever arm coupled to the gear assembly having a first position and a second position;

a linking member coupled to the gear assembly;

a material clamp operatively connected to the linking member; and a cutting blade operatively connected to the linking member, wherein the structure of the lever arm, the gear assembly and the linking member arranged to cooperate to cause the lever arm movement from the first position to the second position and then cause movement of the material clamp towards the base and fix the position of pieces of material located between the base and the material clamp, and wherein the cutting blade uniformly approaches the base such that the blade remains substantially parallel thereto and comes into contact with and severs the pieces of material after the position of the pieces of material has been fixed by the material clamp.

2. The device of claim 1, wherein the gear assembly comprises:

a first toothed gear coupled to the lever arm; and a second toothed gear engaging the first tooth gear and coupled to the linking member.

3. The device of claim 1, wherein the base includes a removable cutting strip positioned substantially below the cutting blade.

4. The device of claim 1, wherein the lever arm includes a handle at one end thereof for gripping by the user along a gripping surface, and wherein the gripping surface includes a major axis that is substantially orthogonal to the major axis of the lever arm.

5. The device of claim 1, further comprising a bridge assembly coupled to the base and comprising a front bridge portion coupled to a rear bridge portion.

6. The device of claim 5, wherein a portion of the lever arm is positioned between the front bridge portion and the rear bridge portion.

7. The device of claim 6, further comprising a bridge cover substantially surrounding the front bridge portion and the rear bridge portion.

8. A device far cutting pieces of material, comprising:

a base;

a gear assembly operatively connected to the base;

a lever arm coupled to the gear assembly having a first position and a second position;

a linking member coupled to the gear assembly;

a material clamp operatively connected to the linking member;

a cutting blade operatively connected to the linking member, and a blade bushing connected to the cutting blade and engaging a slot within the material clamp, wherein movement of the lever arm from the first position towards the second position functioning to cause the blade bushing to force the material clamp and the cutting blade towards the base, the cutting blade remaining substantially parallel to the base as the lever arm moves from the first position towards the second position.

wherein the structure of the lever arm, the gear assembly and the linking member arranged to cooperate to cause the lever arm movement from the first position to the second position and then cause movement of the material clamp towards the base and fix the position of pieces of material located between the base and the material clamp, and wherein the cutting blade moves uniformly towards the base and comes into contact with and severs the pieces of material after the position of the pieces of material has been fixed by the material clamp.

9. The device of claim 8, wherein the blade bushing continues to move towards the base after the material clamp has contacted the pieces of material while the lever arm continues to move from the first position towards the second position.

10. A device for cutting pieces of material, comprising:

a base;

a gear assembly operatively connected to the base;

a lever arm coupled to the gear assembly having a first position and a second position;

a linking member coupled to the gear assembly;

a material clamp operatively connected to the linking member;

a cutting blade operatively connected to the linking member, and a plurality of rollers contacting the cutting blade, wherein the movement of the lever arm from the first position towards the second position results in the rollers applying a force to the cutting blade, the force moving the cutting blade towards the base such that the cutting blade remains substantially parallel with respect to the base, wherein the structure of the lever arm, the gear assembly and the linking member arranged to cooperate to cause the lever arm movement from the first position to the second position and then cause movement of the material clamp towards the base and fix the position of pieces of material located between the base and the material clamp, and wherein the cutting blade comes into contact with and severs the pieces of material after the position of the pieces of material has been fixed by the material clamp.

11. A material trimmer, comprising:

a cutting surface;

a housing operatively connected to the cutting surface;

a lever arm having a major axis;

a handle coupled to the lever arm and having a major axis substantially orthogonal to the major axis of the lever arm;

means for fixing the position of a material to be cut, the means for fixing being operatively connected to the lever arm;

a cutting blade operatively connected to the lever arm, the cutting blade remaining substantially parallel to the cutting surface during a cutting process; and means for adjusting the position of the fixing means and the cutting blade, wherein the material is cut alter the fixing means affixes the position of the material, and wherein the adjusting means comprises:

a gear assembly coupled to the lever arm;

a drive link coupled to the gear assembly;

a plurality of pins, each of the plurality of pins operatively connected to one of the gear assembly and the drive link; and a plurality of rollers each contacting the cutting blade and one of the plurality of pins.

12. A material trimmer, comprising:

a cutting surface;

a housing operatively connected to the cutting surface;

a lever arm having a major axis;

a handle coupled to the lever arm and having a major axis substantially orthogonal to the major axis of the lever arm;

means for fixing the position of a material to be cut, the means for fixing being operatively connected to the lever arm;

a cutting blade operatively connected to the lever arm, the cutting blade remaining substantially parallel to the cutting surface during a cutting process; and means for adjusting the position of the fixing means and the cutting blade, wherein the material is cut after the fixing means affixes the position of the material, and wherein the gear assembly comprises:

a first toothed gear coupled to the lever arm; and a second toothed gear coupled to the drive link and engaging the first toothed gear.

13. A guillotine trimmer, comprising:

a lever arm;

a gear assembly coupled to the lever arm;

a drive link coupled to the gear assembly;

a plurality of pins, each of the plurality of pins operatively connected to one of the gear assembly and the drive link;

a plurality of rollers each contacting one of the plurality of pins;

a cutting blade contacting each of the plurality of rollers;

a clamp operatively connected to the cutting blade; and a cutting surface, wherein the lever arm is structured to move from a first position towards a second position, the cooperation of the gear assembly and the drive link moving the clamp towards the cutting surfaces and affixing the position of pieces of material located between the cutting surface and the clamp, and wherein the cutting blade comes into contact with and severs the pieces of material after the position of the pieces of material has been fixed by the material clamp, the cutting blade remaining substantially parallel to the pieces of material before coming into contact therewith.

14. The guillotine trimmer of claim 13, wherein the gear assembly comprises:

a first toothed gear coupled to the lever arm; and a second toothed gear engaging the first tooth gear and coupled to the drive link.

15. The guillotine trimmer of claim 13, wherein the cutting surface includes a removable cutting strip positioned substantially below the cutting blade.

16. The guillotine trimmer of claim 13, further comprising a biasing mechanism for biasing the cutting blade away from the cutting surface.

17. The guillotine trimmer of claim 13, wherein the lever arm includes a handle at one end thereof for gripping by the user along a gripping surface, and wherein the gripping surface includes a major axis that is substantially orthogonal to the major axis of the lever arm.

18. The guillotine trimmer of claim 13, further comprising a bridge assembly substantially surrounding the gear assembly and the drive link.

19. The guillotine trimmer of claim 18, wherein the bridge assembly comprises a front bridge coupled to a rear bridge, the front bridge and the rear bridge being disposed on substantially opposite sides of the gear assembly and the drive link.

20. The guillotine trimmer of claim 19, further comprising a bridge cover substantially surrounding the front bridge and the rear bridge.

21. The guillotine trimmer of claim 13, further comprising a secondary link for connecting the drive link to one of the rollers.

22. The guillotine trimmer of claim 13, further comprising means for biasing the cutting blade away from the cutting surface.

23. The guillotine trimmer of claim 22, wherein the biasing means comprises a plurality of coil springs positioned atop the cutting surface.

* * * * *